United States Patent [19]

Skakunov

[11] 4,071,164

[45] Jan. 31, 1978

[54] FLOATING ROOF OF A TANK FOR STORING LIQUIDS

[76] Inventor: Mikhail Grigorievich Skakunov, ulitsa Zelenaya, 6, kv. 60, Levoberezhnaya, Moskovskaya oblast, U.S.S.R.

[21] Appl. No.: 804,588

[22] Filed: June 8, 1977

[30] Foreign Application Priority Data

June 14, 1976 U.S.S.R. ..... 2372520

[51] Int. Cl.[2] ..... B65D 87/207; B65D 87/18

[52] U.S. Cl. ..... 220/224; 220/218

[58] Field of Search ..... 220/216, 217, 218, 219, 220/220, 221, 222, 223, 224, 225, 226, 227, 22.1

[56] References Cited

U.S. PATENT DOCUMENTS

| | | | |
|---|---|---|---|
| 1,631,959 | 6/1927 | Glass | 220/216 |
| 1,913,643 | 6/1933 | Smith | 220/221 X |
| 2,036,372 | 4/1936 | Stough | 220/222 |
| 2,437,125 | 3/1948 | Plummer | 220/221 |
| 2,531,424 | 11/1950 | Goldsby et al. | 220/225 |
| 3,409,165 | 11/1968 | Creith | 220/216 |

*Primary Examiner*—Stephen Marcus
*Assistant Examiner*—Steven M. Pollard
*Attorney, Agent, or Firm*—Burgess, Ryan and Wayne

[57] ABSTRACT

A floating roof of a tank for storing liquids consisting of a resilient disc-shaped diaphragm attached, leakproof fashion, all the way around its circumference to an annular seal and further attached to a floating chamber at the center which is fitted to an upright with provision for displacing along same when the level of liquid is changing. The resilient disc-shaped diaphragm is made hollow and is corrugated in the radial and circumferential directions so that the corrugations form a plurality of cells. The diaphragm rests on a series of radially disposed telescopic arms each attached with one of its ends to the floating chamber and resiliently connected at its free end to the annular seal. A rool of this type can practically be used with tanks of any shape.

4 Claims, 5 Drawing Figures

FLOATING ROOF OF A TANK FOR STORING LIQUIDS

The present invention relates to tanks for storing and shipping liquids, and more specifically to floating roofs for such tanks which prevent the evaporation of such volatile liquids as petroleum and wines. Floating roofs made in accordance with the present invention are preferred for use in conjunction with intricately shaped, e.g., spherical, tanks but they are also good for use with tanks of plain shape, i.e., cylindrical ones.

There are known floating roofs for tanks of cylindrical shape with dished top and bottom and a central upright. Each of such roofs is a disc-shaped diaphragm made liquid-tight and attached to an annular seal all the way around its circumference and to a floating chamber, fitted to the upright of the tank, at the centre. The annular seal comprises a plurality of pivotally-interlinked members which allow to change the size of the seal over a comparatively narrow range when the roof is floating either at the top or at the bottom, i.e., within the dished portions of the tank. The members of the seal are provided with floats adding to the buoyancy of the disc-shaped diaphragm.

The known roof floats on the surface of the liquid, rising and lowering with each change of the level in the course of filling or emptying the tank (cf., for example, U.S. Pat. No. 3,366,266). It is used preferably with cylindrical tanks the shape whereof changes but little and with tanks of any other shape characterized by a low rate whereat the diameter changes with height.

Nowadays, for bulk storage of volatile products preference is given to tanks of spherical shape, for the surface of evaporation therein is reduced to a minimum compared with the known tanks. Yet, spherical tanks require much metal for their construction and difficulties are encountered in erecting them. The thickness of the shell, by analogy with any other tanks, depends not only on the tonnage of the product stored but is also influenced by the amount of vapour. To reduce this thickness to an allowable minimum consistent with the tonnage of the product stored, there is a need for some means of suppressing the formation of vapour, such as roofs floating on the surface of the product stored. This will result in maximum saving of metal and simplify the erecting technique.

Since floating roofs so far known fail to render their service in tanks with a rapidly changing diameter, as this is the case in spherical tanks, there is a problem of providing a new floating roof for spherical tanks. This problem is solved by the fact that in a floating roof of a tank for storing liquids consisting of a resilient disc-shaped diaphragm attached, leakproof fashion, all the way around its circumference to an annular seal comprising a plurality of members pivotally interlinked one with another and further attached to a floating chamber at the centre which is fitted to an upright, disposed inside the tank, with provision for displacing along the upright when the level of liquid is changing, the resilient disc-shaped diaphragm is made hollow according to the invention and is corrugated both in the radial and circumferential directions so that the corrugations form a plurality of cells and the disc-shaped hollow diaphragm rests on a series of radially disposed telescopic arms each attached with one of its ends to the floating chamber and resiliently connected at its free end to the annular seal.

It is expedient that the cells communicate in radial directions one with another and with a space in the floating chamber which is filled with a gaseous fluid under excess pressure. A construction like this adds to the buoyancy of the roof, provides for quick response of its members and enhances the leakproofness of the joint between the roof and the shell of the tank.

It is also expedient that roller bearings are provided at the free ends of the telescopic arms, said bearings interacting with the shell of the tank when the roof is being displaced. It is further expedient that guides for the roller bearings are provided on the shell of the tank. The roller bearings operating in conjunction with the guides render the roof more stable at rest and in the course of changing the level of liquid in the tank and enable the roof to withstand the surges of liquid when the tank is being shipped.

A floating roof provided in accordance with the present invention gives the surface of the product stored reliable protection against evaporation. It can be used in tanks of any shape and is particularly effective in spherical tanks, being capable of contracting and expanding while passing from one diameter to another in the course of changing the level of the liquid stored and maintaining a leakproof joint between the seal and the shell of the tank.

A preferred embodiment of the present invention will now be described by way of example with reference to the accompanying drawings in which FIG. 1 is a plan view of the floating roof according to the invention;

Figure 1:
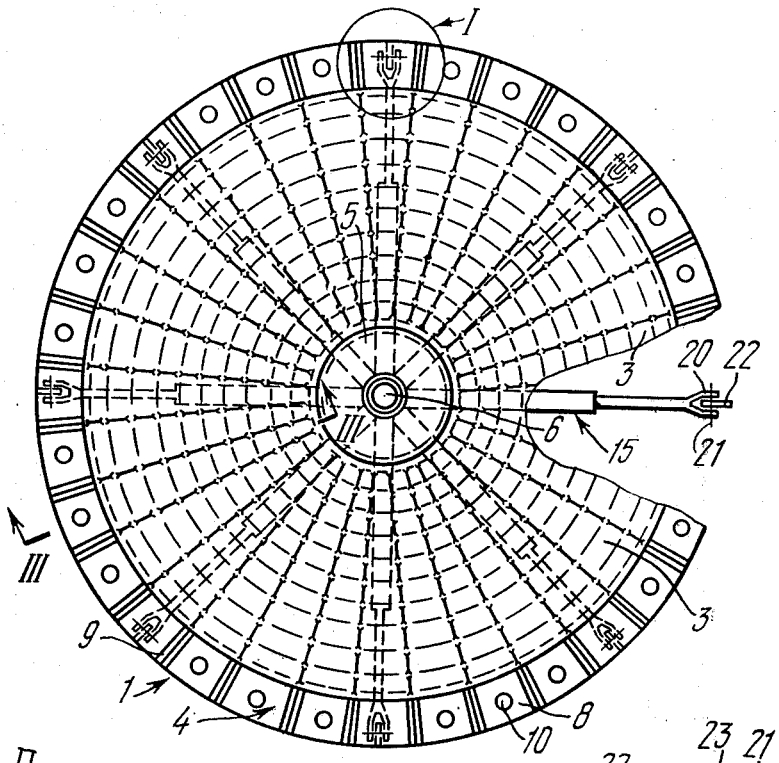
Figure 2:
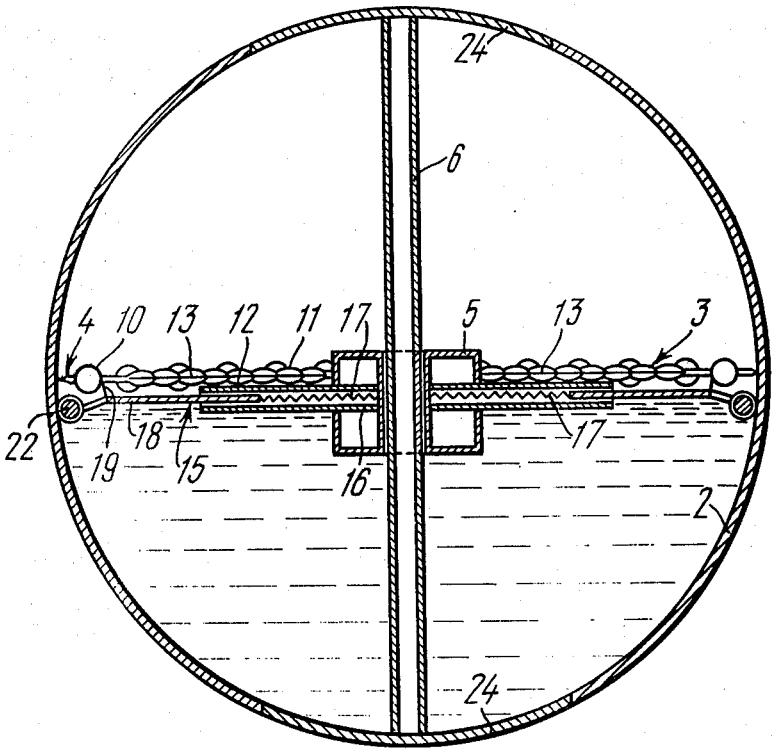
FIG. 2 is a sectional elevation of a tank containing the floating roof according to the invention.

The floating roof 1 illustrated in FIG. 1 and disclosed in the description of the embodiment given hereinbelow is used in a spherical tank 2 (FIG. 2).

Figure 3:
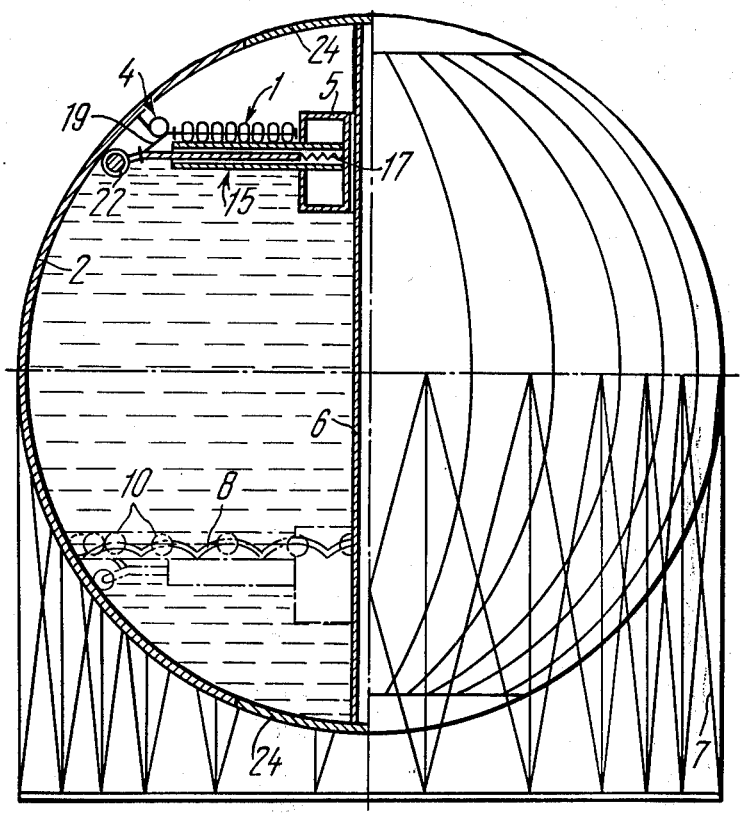
FIG. 3 is a side elevation, partly cut away, of a tank contained wherein is the floating roof in its upper and lower positions (lower position shown in dotted lines)

Referring to FIGS. 1 and 2, a floating roof 1 consists of a resilient disc-shaped diaphragm 3 attached, leakproof fashion, to an annular seal 4 all the way around its circumference and to a floating chamber 5 at the centre. The floating chamber 5 is filled with a gaseous fluid which is air kept under a slightly excessive pressure and is fitted to an upright 6 secured at the centre of a tank 2 consisting of a thin shell resting on supports 7 (FIG. 3). The floating chamber 5 is capable of displacing along the upright 6 when the level of liquid in the tank 2 is changing. The annular seal 4 comprises a plurality of members 8 (FIGS. 1 and 3) interlinked, end to end to end, by means of pivots 9 (FIG. 1) which can be any known pivots of suitable design. A mode of connecting the members 8 like this one allows to change the circumference of the annular seal 4 so as to fit the shell depending on the variations in its diameter. Floats 10 fitted to the members 8 serve to impart buoyancy to the seal 4. In the described embodiment of the invention, the floats 10 are made integrally with the members 8.

Figure 4:
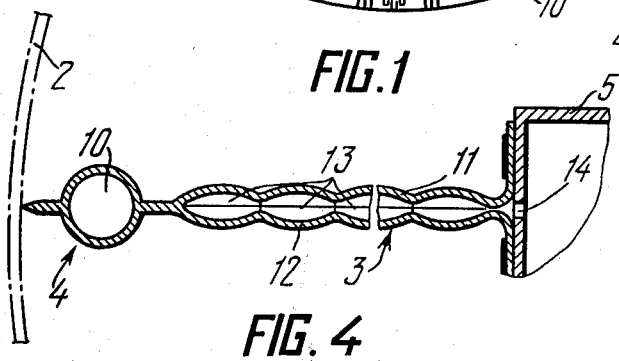
FIG. 4 is a section on line III-III of FIG. 1 on an enlarged scale.

Referring to FIG. 4, the resilient hollow diaphragm 3 consists of two parts which are an upper deck II and a lower deck 12 and is made of a liquid-tight corrugated material, the corrugations running both radially and circumferentially and forming a plurality of cells 13 which communicate radially one with another and are connected to the space inside the floating chamber 5 through passages 14. Owing to this design, the disc-shaped diaphragm 3 can change its area in two directions at right angles to each other.

Figure 5:
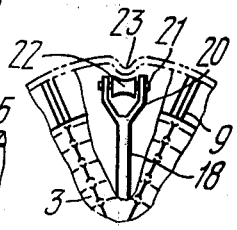
FIG. 5 is a view of portion 1 of FIG. 1 on an enlarged scale.

The diaphragm 3 rests on a framework of telescopic arms 15 (FIGS. 1 and 2) running radially. One end of each telescopic arm shown at 16 is attached to the floating chamber 5 and located inside each telescopic arm is a spring 17 serving to expand this arm. Each free end 18 of the arms 16 is connected to the annular seal 4 through a resilient link 19. The free end 18 of each telescopic arm 15 is provided with a fork 20 (FIG. 5) secured wherein by means of a fulcrum pin 21 is a roller bearing in the form of a roller 22. Guides 23 for each roller 22 are provided on the shell of the tank 2. Used as roller bearings can be any other components suitable for this task.

The floating roof operates on the following lines. On being assembled, the roof is placed inside the tank 2 through a manhole 24 (FIGS. 2 and 3) where it occupies minimum area. The length of its telescopic arms 15 contacting the shell of the tank through the rollers 22 is a minimum one and each of the springs 17 is compressed by the maximum amount. The pivotally interlinked members 8 comprising the seal 4 form a ring of minimum diameter. Since the ends 18 of the arms 15 are connected with the annular seal 4 which, in its turn, is linked up with the cells 13, these cells are compressed to their minimum and occupy the minimum space. The gaseous fluid in the cells 13 is compressed and partially expelled into the floating chamber 5, adding there to the pressure.

When liquid under a pressure is admitted into the tank 2, the roof 1 first settles on its own on the surface of liquid and then expands as the level starts rising. The rollers 22 at the ends of the telescopic arms 15 slide along the guides 23 of the tank 2, following their outline. The springs 17 cause the arms 15 to expand radially so that their length increases and press the annular seal 4 to the shell of the tank 2 at the same time. The force exerted by the expanding arms 15 is transmitted through the annular seal 4 to the cells 13 which start expanding too, being also filled with the gaseous fluid pressure-fed from the floating chamber 5. The cells 13, on being filled with the gaseous fluid, are strained both axially and circumferentially. While the axial strain brings about additional axial forces pressing the annular seal 4 to the shell of the tank 2, the circumferential strain the cells are subject to results in forces which cause the annular seal 4 to expand into a ring of greater diameter due to the movement of its pivotally-interlinked members 8. The floats 10 attached to the seal 4 provide for the buoyancy of the roof 1 at its periphery. So, the liquid pressure-fed into the tank and carrying the roof 1 of its surface causes all the components of this roof to work in tension and compression.

As pointed out above, the roof 1 lying in its initial position on the bottom of the tank has all its components compressed as much as possible and occupies consequently a minimum area. As liquid starts filling the tank, the components of the roof 1 begin to work in tension, both radially and circumferentially, so that the roof expands in area. The components of the roof 2 are under maximum tension in either of the two directions when the level of liquid in the spherical tank 1 is at half-depth and the roof, floating at the equator, occupies the maximum possible area. On passing above the equator, the components of the roof are subject to compression and the roof contracts in area. Thus, in the course of filling the spherical tank 2 with liquid, the components of the roof 1 pass through a closed working cycle consisting of maximum compression, tension, maximum tension, compression, maximum compression. When steps are taken to empty the tank, this cycle is repeated in the reverse order.

What is claimed is:

1. A floating roof of a tank for storing liquids, with an upright centrally secured therein, comprising a floating chamber fitted to said upright of said tank with provision for displacement along the upright when the level of liquid in the tank is changing; a space inside said floating chamber filled with a gaseous fluid under an excess pressure; an annular seal the outward edge whereof is in contact with the shell of the tank; said annular seal comprising a plurality of members pivotally interlinked one with another; a resilient disc-shaped diaphragm attached, leakproof fashion, to said floating chamber at the centre and to said floating seal all the way along its circumference; said resilient disc-shaped diaphragm made hollow and corrugated in the radial and circumferential directions; a plurality of cells formed by the corrugations of said resilient disc-shaped diaphragm; said plurality of cells enabling the disc-shaped diaphragm to expand up to the shell of the tank in all transverse directions when the level of liquid in said tank is changing; a framework resting whereon is said resilient disc-shaped diaphragm, said framework consisting of a plurality of radially disposed telescopic arms each attached with one of its ends to said floating chamber and resiliently connected at its free end to said annular seal.

2. A floating roof as claimed in claim 1, wherein the cells of said plurality communicate in radial directions one with another and with the space in the floating chamber which is filled with a gaseous fluid under excess pressure.

3. A floating roof as claimed in claim 1, wherein roller bearings are provided at the free ends of the telescopic arms, said bearings interacting with the shell of the tank when the roof is being displaced.

4. A floating roof as claimed in claim 3, wherein guides for the roller bearings are provided on the shell of the tank.

* * * * *